United States Patent [19]

Harmon

[11] 4,345,135

[45] Aug. 17, 1982

[54] DELAY-START ARRANGEMENT FOR A MICROWAVE OVEN

[75] Inventor: Larry R. Harmon, Louisville, Ky.

[73] Assignee: General Electric Company, Louisville, Ky.

[21] Appl. No.: 210,942

[22] Filed: Nov. 28, 1980

[51] Int. Cl.[3] ..... H05B 6/68

[52] U.S. Cl. ..... 219/10.55 B; 219/10.55 C; 361/194

[58] Field of Search ..... 219/10.55 B, 10.55 R, 219/10.55 C; 361/194, 189

[56] References Cited

U.S. PATENT DOCUMENTS

| | | | |
|---|---|---|---|
| 3,407,306 | 10/1968 | Huntzinger | 361/194 X |
| 3,860,910 | 1/1975 | Hudson | 361/194 X |
| 3,962,611 | 6/1976 | Miller | 317/154 |
| 4,011,428 | 3/1977 | Fosnough et al. | 219/10.55 B |
| 4,027,208 | 5/1977 | Look | 361/194 |
| 4,096,542 | 6/1978 | Pappas et al. | 361/196 |
| 4,121,079 | 10/1978 | Harmon | 219/10.55 B |
| 4,177,369 | 12/1979 | Fritts | 219/10.55 B |
| 4,190,756 | 2/1980 | Foerstner | 219/10.55 B |

*Primary Examiner*—Arthur T. Grimley
*Attorney, Agent, or Firm*—H. Neil Houser; Radford M. Reams

[57] ABSTRACT

A circuit for turning on the constantly energized loads in a microwave oven in response to the initial energization of the magnetron to begin the cooking operation. The circuit includes a delay start relay having a relay coil and a first normally closed relay switch connected in series with a magnetron switching element across a source to respond to the initial turn-on of the magnetron by the switching element. The relay coil also controls a second normally open relay switch connected to close, in response to energization of the relay, a current path including at least one constantly energized microwave oven load. The second relay switch also closes a holding current path for the relay coil to maintain it in an energized condition during the remainder of the cooking cycle. The first relay switch opens after the second relay switch has closed to electrically isolate the relay coil from the switching device. At the end of the cooking cycle a main power switch is opened in response to a signal from the electronic control system to terminate the cooking operation and to reset the delay start relay.

9 Claims, 1 Drawing Figure

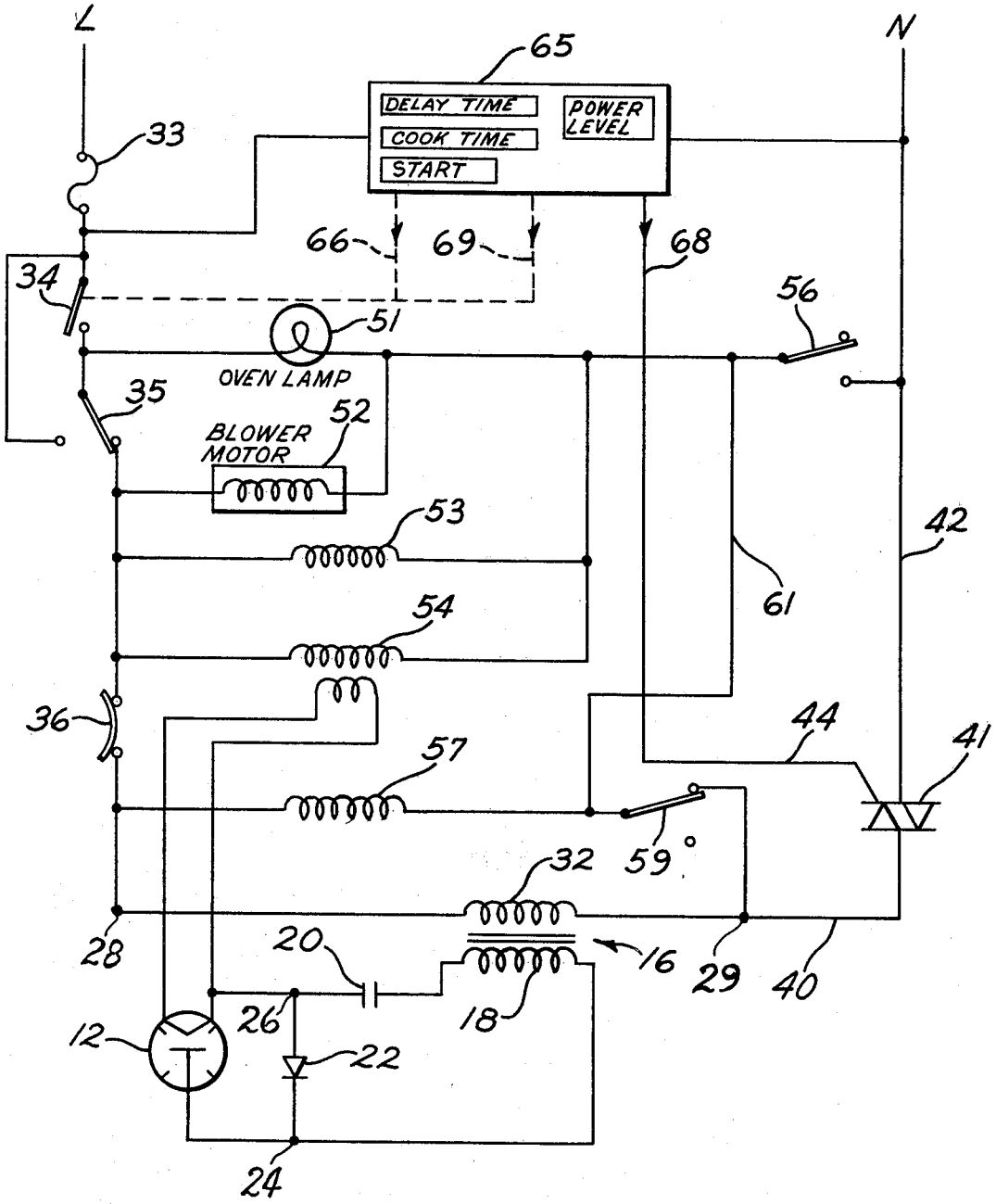
L
N
65
DELAY TIME
COOK TIME
START
POWER LEVEL
33
34
66
69
68
56
51
OVEN LAMP
35
52
BLOWER MOTOR
53
42
61
54
36
44
41
57
59
32
28
20
16
29
40
26
18
12
22
24

DELAY-START ARRANGEMENT FOR A MICROWAVE OVEN

BACKGROUND OF THE INVENTION

1. Field of the Invention

The present invention relates generally to a microwave oven of the type including a duty cycle control which periodically energizes and de-energizes the microwave generating system during the cooking process and, more particularly, to a circuit arrangement for providing an improved delay start feature in such an oven without costly changes in the programming or circuitry which controls oven operation.

2. Description of the Prior Art

It is common in commercially available, electronically controlled microwave ovens to provide a delay start feature. Such a feature permits a microwave oven user to program the control circuitry of the oven so that a cooking operation begins at a later time, the delay time being entered by the user into the oven controls. Thus, an operator of an oven desiring to use such a feature places food in the oven; selects a particular power level at which he desires to cook the food and the time duration for the food to cook and enters this information into the oven control system; selects and enters a time delay (usually in the form of a preselected number of minutes) into the control, then usually presses a "start" button on the control signalling the completion of cooking instructions, and leaves the oven unattended.

Microwave ovens heat food by subjecting it to microwave radiation generated by a magnetron. Most microwave ovens vary the cooking power level by using a duty cycle control to operate the magnetron. In the operation of a duty cycle control, the magnetron is switched between a full-on condition and a full-off condition with the percentage of "on" time compared to the total time of each timing period (duty cycle) being varied to change the cooking power delivered to the food. Various specific circuits to provide this duty cycle are well known in the art. These range from simple cam operated mechanical timers having electrical controls to operate the magnetron to more sophisticated systems employing electronic solid state timing and switching elements. Since the duty cycle control does not form a part of this invention, it will not be described in detail. The magnetron therefore represents a first class of load in a microwave oven which is energized intermittently during the cooking process.

As contrasted to the intermittent operation of the magnetron, the microwave oven also includes various other electrical loads which are desirably energized continuously during the cooking process, such as the mode stirrer motor, the magnetron cooling blower and the filament heater for the magnetron.

In microwave ovens having a delay start feature, provision is usually made to control the continuously energized loads separately from the magnetron. More specifically, it is not possible to control these continuously energized loads using the same switching device that controls the magnetron because the latter is operated in an intermittent or duty cycle controlled fashion.

One solution to this problem is to turn on the constantly energized loads when the oven user completes entry of the delay start instructions into the oven controls. In this arrangement, the mode stirrer motor, blower, etc., are energized by activating the start button, or other equivalent input control device and remain energized continuously during the delay time period when the magnetron is idle, waiting for the beginning of the cooking cycle.

The obvious disadvantage of such a scheme is that power used to drive these loads is wasted during the time when they are not functionally needed to support the cooking operation. In addition, the noise caused by operation of these loads is undesirable and distracting.

Another solution to the above mentioned problem is to control the continuously energized loads by means of a separate independent signal developed by the oven control after the time delay period has passed at the beginning of the cooking cycle, i.e. when the magnetron is initially energized. This may be typically done by utilizing an additional input/output port on the microprocessor control with appropriate programming to carry out this function. In addition, an electronic switching element, associated drive electronics and isolators must be employed to implement this approach, resulting in a significantly additional cost. Moreover, it is sometimes difficult to couple additional electronics to an already existing control package without a significant redesign effort.

OBJECTS AND SUMMARY OF THE INVENTION

It is therefore one object of the invention to provide an improved delay start feature for a microwave oven having an electronic control system which duty cycles the magnetron during the cooking process in accordance with different power levels selected by an oven operator.

It is another object of the invention to provide such a circuit which is both effective and yet extremely low in cost.

A further object of the invention is the provision of a delay start circuit for a microwave oven in which the continuously energized loads of the oven are keyed into operation by the first turn-on of the switching element controlling the magnetron.

A further object of the invention is the provision of a delay start feature for microwave ovens in which the continuously energized loads of the oven are keyed into operation without the use of separate control signals from the electronic control dedicated specifically for this purpose.

Yet a further object is the provision of an improved delay start circuit which may be easily added to existing microwave oven control systems without significant redesign of the existing circuitry.

These and other objects are accomplished by the provision of a circuit for turning on the constantly energized loads in a microwave oven in response to the initial momentary energization of the magnetron to begin the cooking operation and maintaining these loads energized even though the magnetron is turned off intermittently during the remainder of the cooking cycle. The circuit includes a delay start relay having a relay coil and a first normally closed relay switch connected in series with a magnetron switching element across a source to respond to the initial turn-on of the magnetron by the switching element. The relay coil also controls a second normally open relay switch connected to close, in response to energization of the relay, a current path including at least one constantly energized microwave oven load. The second relay switch also closes a holding current path for the relay coil to maintain it in an energized condition during the remainder of the cooking cycle. The first relay switch opens after the second relay switch has closed to electrically isolate the relay coil from the switching device. At the end of the cooking cycle a main power switch is opened in response to a signal from the electronic control system to terminate the cooking operation and to reset the delay start relay.

BRIEF DESCRIPTION OF THE DRAWING

While the novel features of the invention are set forth with particularity in the appended claims, the invention both as to organization and content, will be better understood and appreciated, along with other objects and features thereof, from the following detailed description when taken in conjunction with the attached drawing which is a simplified schematic circuit diagram of the microwave oven illustrating the general principles of the invention.

DESCRIPTION OF THE PREFERRED EMBODIMENT

Referring to the drawing, there is shown a simplified wiring diagram of a circuit embodying the invention for a microwave oven. The illustrated circuit is adapted to be connected between one power line "L" and the neutral conductor "N" of a standard 220–240 volt, 60 Hz, single phase, three wire supply network, the voltage between "L" and "N" being in the range of 110–120 volts.

The circuit includes a magnetron 12 which generates cooking microwaves when energized from a suitable high voltage DC source. The magnetron power supply includes a power transformer 16 having a high voltage secondary winding 18 connected to energize the magnetron 12 through a half-wave voltage doubler comprising a series capacitor 20 and a rectifying diode 22 connected across the magnetron anode and cathode terminals 24 and 26, respectively, and oppositely poled with respect thereto.

The power line "L" is coupled to the terminal 28 of the primary 32 of transformer 16 through a fuse 33, a main power relay switch 34, a door interlock switch 35 and a thermal protector 36. The fuse 33 functions to protect the entire circuit against electrical overcurrents. The door interlock switch 35 prevents hazardous operation of the microwave oven in an open-door condition by insuring that the microwave oven door is closed prior to energization of the magnetron. When the oven door is closed, switch 35 is normally in the position shown in the drawing in order to enable power to be applied to the oven. Thermal protector 36, which may be a bimetal strip, or equivalent, is positioned to measure the temperature of the magnetron and interrupt power in the event of overheating.

The main power relay switch 34 operates to control the cooking operation by turning on the oven in response to the manual actuation of a start button or switch on the oven input controls signalling completion of operation instructions into the oven control, and turning off the oven at the completion of the preselected cooking operation. The switch 34 is under the control of the electronic control system 65 coupled across the lines "L" and "N", the operation of which will be explained in greater detail hereinafter.

The other side 29 of the primary winding 32 is coupled to a main power terminal of a switching element by a conductor 40, the other main terminal of the switching element being returned to the power line "N" via line 42. The particular switching element illustrated is a triac 41 having a gate terminal 44. Suitable switching circuitry which is part of the electronic control package 65 is coupled to the gate terminal 44 to operate the triac in a duty cycle control mode. It will be appreciated, however, that other types of controlled switching elements may be employed, such as relay contacts or cam operated switches.

Additionally, connected across the "L" and "N" power source terminals are a group of loads 51–54 which are continuously energized during operation of the microwave oven. The loads 51 and 52 consist of an oven lamp and a blower motor which are used to illuminate the oven interior and cool the electronic package, respectively. The load 54 comprises the primary of the filament transformer which heats the cathode of the magnetron tube 12. The load 53 comprises a mode stirrer motor which is used in conventional ovens to drive a conductive fan-like member adjacent the main feed input of microwave energy into the oven cooking cavity to continuously change the mode patterns in the oven and thereby achieve more uniform cooking of food in the oven, as is well known to those skilled in the art.

Each of the loads 51–54 is connected across the power lines "L" and "N" via a normally open first relay switch 56 and one or both of the switches 34 and 35, the switch 56 being operated by a relay coil 57. Assuming coil 34 is closed and switch 35 is in the position shown in the drawing, when the relay contacts 56 close each of the loads 51–54 is energized from the power source. Thus, the switch 56 functions to close and open current paths across the power source through the continuously energized loads 51–54.

The relay coil 57 also controls a normally closed second relay switch 59 which is connected in series with the coil 57 across the power source via the triac 41. More specifically, assuming switches 34 and 36 are closed and switch 35 is in the position shown, whenever the triac 41 is turned on current flows through relay coil 57 and first relay switch 59 to energize the coil. The coil 57, in turn, operates to close relay switch 56. The switches 56 and 59 are designed such that switch 56 closes prior to the opening of the switch 59. In this manner a holding current path is provided across the power source through the coil 57, the conductor 61 and the closed switch 56. Thus, relay switch 59 functions to close a relay pull-in current path when the triac 41 is turned on, while relay switch 56, in addition to closing a current path to the continuously energized loads 51–54, also controls a holding current path for the relay coil 57 after the switch 59 opens.

The electronic control 65 provides the necessary control signals for governing the cooking operation. Such controls are well known in the art and will be described hereafter only functionally as it relates to the operation of the circuit according to the invention. The control, in a known manner, provides for an input panel having a means whereby an oven operator may enter the time for which food is to cook (cook time), the power level at which the magnetron 12 is to operate during this time, and the time after actuation of the "start" button (delay time) at which the cooking operation is to begin.

In response to these inputs from an oven operator, the electronic control 65 provides a first signal on line 66 to close the power relay contacts 34 in response to engagement of the start button by the operator. The control 65, after passage of a period of time equal to the time delay period entered, generates a signal on line 68 which triggers the triac 41 on and off for a time period equal to the cook time and in a manner to provide a cooking power selected by the operator. As an example, if the operator selects a power level midway between the highest and lowest settings provided, an approximately 50% duty cycle signal is generated on line 68 which triggers the triac on for approximately half the cooking time and off for half of the cooking time. The above signal on line 68 persists until the cook time selected has expired, at which time it ceases and a stop cook signal is provided on line 69 to end the cooking operation by opening the power relay switch 34.

It should be understood that the electronic controls on commercially available ovens have capabilities which exceed those outlined briefly above, but only those signals needed to accomplish the delay start feature of the invention have been discussed above.

The delay start feature is provided in accordance with the invention as follows: Assuming the oven operator has made entries into the electronic control noted above, the switch 34 is closed, relay switch 56 is open and relay switch 59 is closed, when the electronic control 65 generates a signal on line 68 to operate the triac 41, the magnetron power transformer 16 is energized which in turn provides a high voltage signal at the terminals of the magnetron tube 12. Since relay switch 59 is closed, a relay pull-in current flows through the current path including the coil 57, the switch 59 and the triac 41. This current through the relay coil 57 in turn closes the relay switch 56 which completes current paths across the power source through the continuously energized loads 51–54. Thus, loads 51–54 begin operating concurrently with the magnetron. Closing of switch 56 also completes a holding current path through the coil 57 and conductor 61 across the power source which permits contact 59 to open without de-energizing the relay coil 57.

The opening of switch 59 breaks the pull-in current path and isolates the relay coil 57 from the triac 41. Thus, subsequent cycling of the triac 41 does not affect the energization of the relay coil 57 or the continuously energized loads 51–54. The cooking process continues in this fashion with the triac being cycled on and off under the control of signals on line 68 from the electronic control.

At the completion of the cooking time selected by the operator, the power relay contacts 34 are opened to end the cooking cycle. This results in a de-energization of the coil 57 and an opening of switch 56 and closing of switch 59. The process is repeated on subsequent cooking cycles.

It will be apparent, therefore, that the present invention provides an effective and inexpensive circuit for carrying out a delay start operation in a microwave oven whereby the constantly energized loads in the oven are coupled to the power source in response to the initial turn-on of the magnetron. Thereafter the continuously energized loads continue to operate notwithstanding the cycling on and off of the magnetron in response to triggering of a duty cycle controlled switching element. The arrangement is moveover accomplished without the need for independent control signals and associated electronics from a control system, but, rather, utilizes control signals already provided to operate the duty cycle switchable element which controls the magnetron.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A microwave oven circuit adapted for coupling to a power source comprising:

a magnetron, a duty cycle controlled switching element, a first current path across said source including said duty cycle controlled switching element to periodically close said first current path to energize said magnetron, a delay start relay including a first normally closed relay switch and a second normally open relay switch, at least one electrical load adapted to be continuously energized from the power source during the cooking process, a second current path across the source including said relay, said first relay switch and said element, a third current path across the source including said one load and said second relay switch, and a fourth current path across the source including said relay and said second relay switch for providing a holding current to said relay after said first relay switch opens, whereby said relay is energized in response to initial turn-on of said magnetron by said switching element to thereby close said second relay switch and energize said one load and open said first relay switch to electrically isolate said relay coil from said switching element.

2. The combination recited in claim 1 wherein said switching element is a triac.

3. The combination recited in claim 1 wherein said relay includes a coil connected in said second and fourth current paths.

4. In a microwave oven circuit adapted for coupling to a power supply and having a magnetron, a duty cycle controlled switching element for intermittently energizing said magnetron as a function of a cooking power level selected by an oven user, control means for generating signals to permit an oven user to program the oven to begin a cooking operation after a preselected time delay by providing a duty cycle signal to said switching element which begins after said preselected time delay and continues for a preselected cooking time, and at least one electrical load adapted for operation continuously when said magnetron is operating intermittently, the improvement comprising means responsive to the initial turn-on of said switching element and magnetron to close a current path to said one electrical load and to maintain closure of said current path to continuously energize said one load while said switching element is turned on and off intermittently during said cooking time.

5. The combination recited in claim 4 wherein said means includes a relay having a first normally closed relay switch and a second normally open relay switch, said relay connected in circuit with said element for energization when said magnetron is initially turned on, said relay, when energized, being operative to close said second switch, said second switch connected to close a circuit path through said one load across said source, and to close a holding current path to said relay, said relay, when energized, being operative to open said first relay switch to electrically isolate said relay from said element.

6. The combination recited in claim 5 wherein said relay includes a coil coupled in series with said first relay switch and said switching element.

7. The combination recited in claim 6 wherein said second relay switch is connected in parallel with said first relay switch to close said holding current path through said coil across said source for maintaining said coil energized when said first switch is open.

8. The combination recited in claim 7 wherein said switching element is a triac, and said magnetron is driven by a transformer having a primary winding in series with said triac across said source.

9. The combination recited in claim 8 wherein said relay is de-energized by a signal generated by said control means at the end of said cooking time.

* * * * *